US008968084B2

(12) United States Patent
Bytnar et al.

(10) Patent No.: US 8,968,084 B2
(45) Date of Patent: Mar. 3, 2015

(54) PROCESSING METADATA IN WAGERING GAME SYSTEMS

(75) Inventors: Michael R. Bytnar, Naperville, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 1451 days.

(21) Appl. No.: 12/303,579

(22) PCT Filed: Jun. 5, 2007

(86) PCT No.: PCT/US2007/013252

§ 371 (c)(1),
(2), (4) Date: Dec. 5, 2008

(87) PCT Pub. No.: WO2007/145954

PCT Pub. Date: Dec. 21, 2007

(65) Prior Publication Data

US 2011/0183763 A1 Jul. 28, 2011

Related U.S. Application Data

(60) Provisional application No. 60/804,126, filed on Jun. 7, 2006.

(51) Int. Cl.
*A63F 9/24* (2006.01)

(52) U.S. Cl.
USPC ..... 463/29; 463/24

(58) Field of Classification Search
USPC ..... 463/29, 42; 715/854; 709/225, 249
See application file for complete search history.

(56) References Cited

U.S. PATENT DOCUMENTS

| | | | | |
|---|---|---|---|---|
| 4,297,729 | A | 10/1981 | Steynor et al. | |
| 4,980,782 | A | 12/1990 | Ginkel | |
| 5,643,086 | A | 7/1997 | Alcorn et al. | |
| 5,889,868 | A | 3/1999 | Moskowitz et al. | |
| 5,960,081 | A | 9/1999 | Vynne et al. | |
| 6,038,288 | A | 3/2000 | Thomas et al. | |
| 6,190,257 | B1 | 2/2001 | Takeda et al. | |
| 6,229,924 | B1 | 5/2001 | Rhoads et al. | |
| 6,411,725 | B1 | 6/2002 | Rhoads | |
| 6,456,308 | B1 * | 9/2002 | Agranat et al. | 715/854 |
| 6,508,709 | B1 | 1/2003 | Karmarkar | |
| 6,508,729 | B1 | 1/2003 | Coltrane et al. | |
| 6,595,856 | B1 | 7/2003 | Ginsburg et al. | |
| 6,685,567 | B2 | 2/2004 | Cockerille et al. | |
| 6,823,075 | B2 | 11/2004 | Perry | |

(Continued)

FOREIGN PATENT DOCUMENTS

| | | | |
|---|---|---|---|
| WO | WO-2007145954 | A2 | 12/2007 |
| WO | WO-2007145954 | A3 | 12/2007 |

OTHER PUBLICATIONS

"U.S. Appl. No. 11/425,831, Final Office Action mailed Mar. 3, 2009", 10 pgs.

(Continued)

*Primary Examiner* — Masud Ahmed
(74) *Attorney, Agent, or Firm* — Nixon Peabody LLP

(57) ABSTRACT

This description describes wagering game systems that process metadata. In one embodiment, the apparatus includes a wagering game presentation unit configured to present wagering games and create extended metadata and wager gaming content. The apparatus can also include operating system modules configured to store the wager gaming content as a file in a file system and to store the extended metadata at locations associated with the file.

19 Claims, 9 Drawing Sheets

(56) References Cited

U.S. PATENT DOCUMENTS

| | | | | |
|---|---|---|---|---|
| 6,975,743 | B2 | 12/2005 | Venkatesan et al. | |
| 6,979,266 | B2 | 12/2005 | Lemay et al. | |
| 7,007,166 | B1 | 2/2006 | Moskowitz et al. | |
| 7,058,813 | B2 | 6/2006 | Burns | |
| 7,062,069 | B2 | 6/2006 | Rhoads | |
| 7,113,612 | B2 | 9/2006 | Sugahara et al. | |
| 7,113,615 | B2 | 9/2006 | Rhoads et al. | |
| 7,130,443 | B1 | 10/2006 | Werner et al. | |
| 7,162,036 | B2 | 1/2007 | Rowe | |
| 7,209,571 | B2 | 4/2007 | Davis et al. | |
| 7,285,048 | B2 | 10/2007 | Karmarkar | |
| 7,461,394 | B1 | 12/2008 | Sano | |
| 7,846,023 | B2 | 12/2010 | Evans | |
| 2001/0025256 | A1* | 9/2001 | Oliphant et al. | 705/26 |
| 2001/0049788 | A1 | 12/2001 | Shur | |
| 2001/0051996 | A1 | 12/2001 | Cooper et al. | |
| 2002/0009208 | A1 | 1/2002 | Alattar et al. | |
| 2002/0178368 | A1 | 11/2002 | Yin et al. | |
| 2003/0037075 | A1 | 2/2003 | Hannigan et al. | |
| 2003/0056012 | A1* | 3/2003 | Modeste et al. | 709/249 |
| 2003/0069071 | A1 | 4/2003 | Britt et al. | |
| 2003/0140141 | A1* | 7/2003 | Mullen et al. | 709/225 |
| 2003/0195033 | A1 | 10/2003 | Gazdic et al. | |
| 2003/0204727 | A1 | 10/2003 | Sasaki | |
| 2004/0048668 | A1 | 3/2004 | Brosnan | |
| 2004/0242322 | A1* | 12/2004 | Montagna et al. | 463/29 |
| 2004/0248646 | A1 | 12/2004 | Canterbury | |
| 2004/0259643 | A1 | 12/2004 | Gentles | |
| 2005/0009599 | A1 | 1/2005 | Ryan | |
| 2005/0107163 | A1 | 5/2005 | Nguyen et al. | |
| 2005/0143171 | A1 | 6/2005 | Loose | |
| 2005/0192099 | A1 | 9/2005 | Nguyen et al. | |
| 2005/0232417 | A1 | 10/2005 | Roberts et al. | |
| 2005/0261062 | A1* | 11/2005 | Lewin et al. | 463/42 |
| 2005/0272501 | A1 | 12/2005 | Tran et al. | |
| 2007/0006275 | A1 | 1/2007 | Wright et al. | |
| 2007/0021195 | A1 | 1/2007 | Campbell et al. | |
| 2007/0021196 | A1 | 1/2007 | Campbell et al. | |

OTHER PUBLICATIONS

"U.S. Appl. No. 11/458,469, Examiner Interview Summary Received Apr. 6, 2009", 2 pgs.

"U.S. Appl. No. 11/458,469, Final Office Action mailed May 3, 2010", 10 pgs.

"U.S. Appl. No. 11/458,469, Response filed Mar. 30, 2009 to Non Final Office Action mailed Sep. 30, 2008", 11 pgs.

"U.S. Appl. No. 11/458,469, Response filed May 6, 2009 to Examiner Interview Summary Received Apr. 6, 2009", 1 pg.

"U.S. Appl. No. 11/425,831, Response filed Sep. 2, 2008 to Non Final Office Action mailed Apr. 2, 2008", 9 pgs.

"U.S. Appl. No. 11/425,831 Non-Final Office Action mailed Apr. 2, 2008", 11pgs.

"U.S. Appl. No. 11/458,469, Non-Final Office Action mailed Sep. 30, 2008", 9 pgs.

"International Application Serial No. PCT/US2007/013252, International Search Report and Written Opinion mailed Aug. 20, 2008", 9 pgs.

* cited by examiner

PROCESSING METADATA IN WAGERING GAME SYSTEMS

RELATED APPLICATION

This patent application is a U.S. National Stage Filing under 35 U.S.C. 371 from International Patent Application Serial No. PCT/US2007/013649, filed Jun. 8, 2007, and published on Dec. 21, 2007, as WO 2007/146205 A2, which claims the priority benefit of U.S. Provisional Patent Application Ser. No. 60/804,126 filed Jun. 7, 2006 and entitled "PROCESSING METADATA IN WAGERING GAME SYSTEMS", the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007, WMS Gaming, Inc.

FIELD

Embodiments relate generally to wagering game systems, and more particularly, to processing metadata in wagering game systems.

BACKGROUND

Wagering game machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the present invention are illustrated by way of example and not limitation in the Figures of the accompanying drawings in which.

DESCRIPTION OF THE EMBODIMENTS

Introduction

Embodiments of the invention can create, modify, store, retrieve, and otherwise process extended metadata in wagering game systems. Extended metadata can differ from typical pre-defined file system metadata, which often includes information about file size, file name, timestamps, user access privileges, etc. In contrast, extended metadata can include information about entities that create files (e.g., lens type on digital camera), statistics about entities that have accessed files, application-defined metadata fields, or any other information about wagering game systems. In some embodiments, wagering game systems can utilize extended metadata to configure components, optimize processes, customize services, etc. These and other features will be described in greater detail below.

Example Operating Environment

Example Wagering Game Machine Architecture

Figure 1:
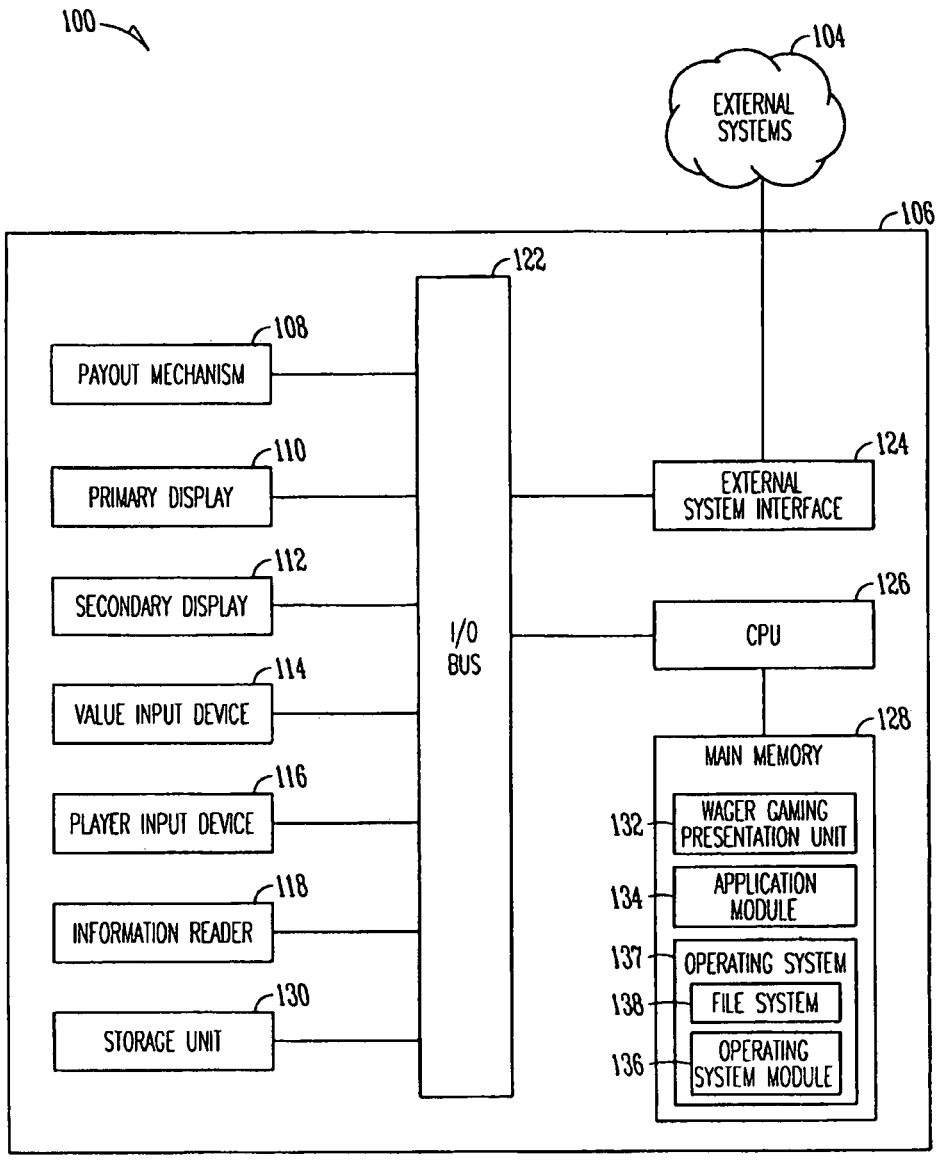
FIG. 1 is a block diagram illustrating a wagering game machine architecture, according to example embodiments of the invention.

FIG. 1 is a block diagram illustrating a wagering game machine architecture, according to example embodiments of the invention. As shown in FIG. 1, the wagering game machine 106 includes a central processing unit (CPU) 126 connected to main memory 128, which includes a wagering game presentation unit 132, application modules 134, and an operating system 137 that includes operating system modules 136 and a file system 138. In one embodiment, the wagering game presentation unit 132 can present wagering games, such as video poker, video black jack, video slots, video lottery, etc., in whole or part.

In one embodiment, the application modules 134 and operating system modules 136 can perform operations on files stored in the file system 138. The operations can include creating, deleting, and/or modifying extended metadata associated with files. The extended metadata can be distinct from pre-defined file system metadata associated with the files. For example, in one embodiment, the extended metadata does not include typical file system metadata, such as timestamps, user access privileges, file size, file name, etc. Instead, the extended metadata can include information about entities that created a file (e.g., properties of a camera that created an image file), statistics about processes that have accessed the file (e.g., how often an application accesses a file), and/or any other information created or determined by components that access the file. For example, extended metadata of a file representing a hardware device can describe hardware features, requirements, and/or statistics. In one embodiment, extended metadata can be stored inside files of the file system 138, whereas in other embodiments, the extended metadata is not stored inside the files. Some embodiments store extended metadata separate from the file system 138 altogether. In one embodiment, extended metadata can be protected using access privileges separate from those used by the file system. The following sections will provide additional examples describing how embodiments can store and process extended metadata.

The CPU 126 is connected to an input/output (I/0) bus 122, which facilitates communication between the wagering game machine's components. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include multiple external system interfaces 124 and multiple CPUs 126. In one embodiment, any of the components can be integrated or subdivided. Additionally, any of the components can be implemented exclusively in hardware, exclusively in software, or a combination of hardware and software. For example, the wagering game presentation unit 132 can be implemented as an application specific integrated circuit. Furthermore, the components of the wagering game machine 106 can be interconnected according to any suitable interconnection architecture (e.g., directly connected, hypercube, etc.).

In one embodiment, any of the components of the wagering game machine 106 (e.g., the wagering game presentation unit 132) can include hardware, firmware, and/or software for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Extended Wager Gaming Metadata Storage

This section continues with a discussion about how embodiments can organize and store extended metadata in wager gaming systems.

Figure 2:
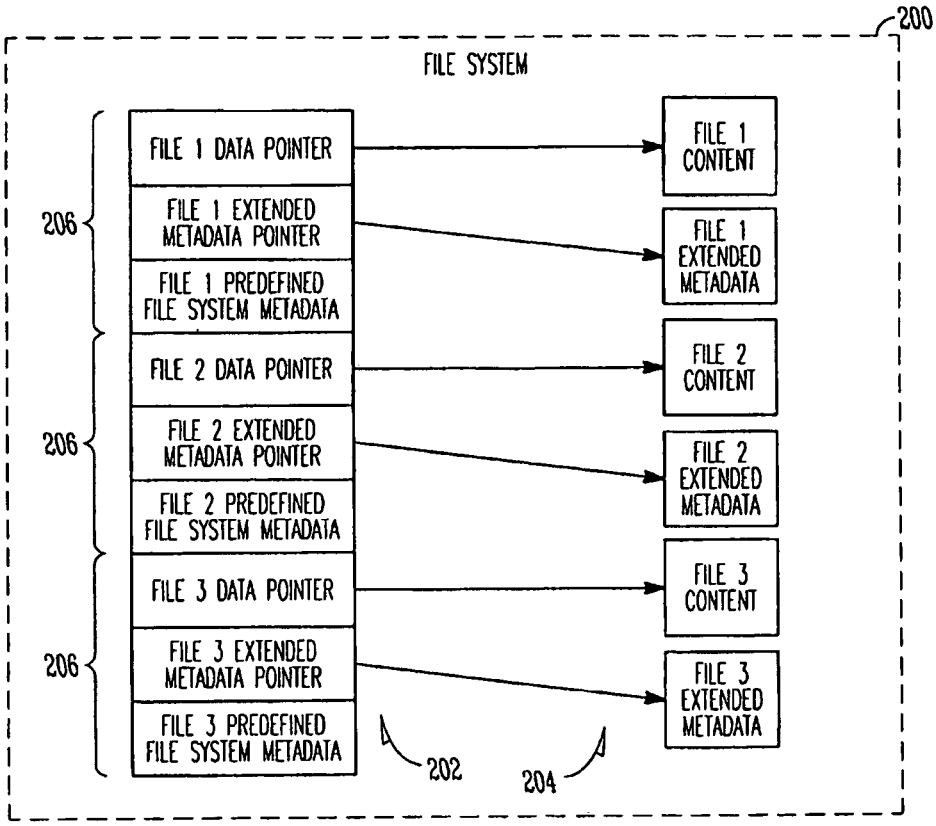
FIG. 2 is a block diagram illustrating a file system in which extended metadata and file content are stored separately, according to example embodiments of the invention.

FIG. 2 is a block diagram illustrating a file system in which extended metadata and file content are stored separately, according to example embodiments of the invention. In FIG. 2, the file system 200 includes a file index table 202, which includes entries 206 corresponding to files. Each entry 206 includes predefined file system metadata and pointers to a file's content (e.g., wager gaming content) and extended metadata 204. An operating system can access a file's content and extended metadata by searching for a file's unique identifier in the file index table 202 and following the pointers the content and extended metadata.

Figure 3A:
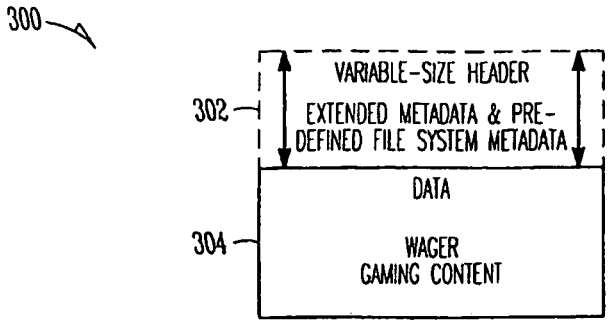
FIG. 3A is a block diagram illustrating a file format for storing extended metadata in a variable-size header, according to example embodiments of the invention.
Figure 3B:
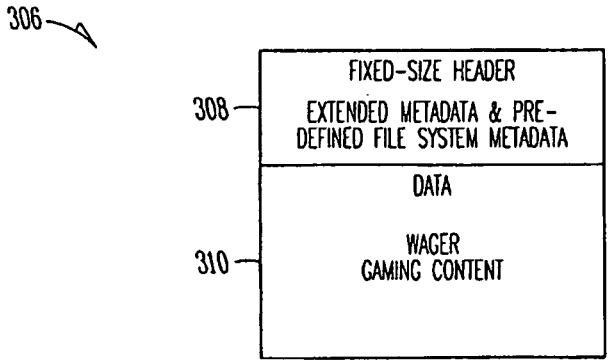
FIG. 3B is a block diagram illustrating a file format for storing extended metadata in a fixed-size header, according to example embodiments of the invention.
Figure 3C:
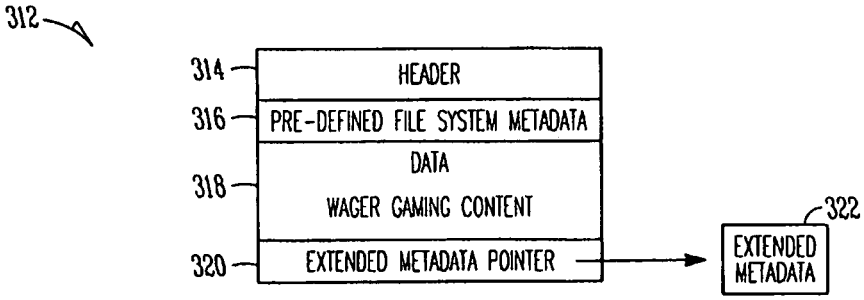
FIG. 3C is a block diagram illustrating a file format in which extended metadata associated with the file becomes accessible by accessing a file, according to example embodiments of the invention.

While FIG. 2 presents one organization for storing file content and extended metadata in a file system, FIGS. 3A-3C show other ways for storing file content and extended metadata in file systems.

FIG. 3A is a block diagram illustrating a file format for storing extended metadata in a variable-size header, according to example embodiments of the invention. In FIG. 3A, a file 300 includes a variable-size header 302 and a data section 304. The variable-size header 302 can store both extended metadata and predefined file system metadata. In one embodiment, the variable-size header 302 can dynamically grow or shrink depending on how much extended metadata the file 300 will include.

FIG. 3B is a block diagram illustrating a file format for storing extended metadata in a fixed-size header, according to example embodiments of the invention. In FIG. 3B, a file 306 includes a fixed-size header 308 and a data section 310. The fixed-size header 308 can store both extended metadata and predefined file system metadata. In one embodiment, the fixed-size header's size remains constant. Thus, in one embodiment, the amount of extended metadata is limited by the size of the fixed-size header 308.

FIG. 3C is a block diagram illustrating a file format in which extended metadata associated with the file becomes accessible by accessing a file, according to example embodiments of the invention. In FIG. 3C, a file 312 includes a header 314, a predefined file system metadata section 316, a data section 318, and an extended metadata pointer 320. The extended metadata pointer 320 includes a reference to a location at which extended metadata 322 is stored. The extended metadata 322 can be accessed by accessing the file and determining the extended metadata pointer 320.

Figure 4:
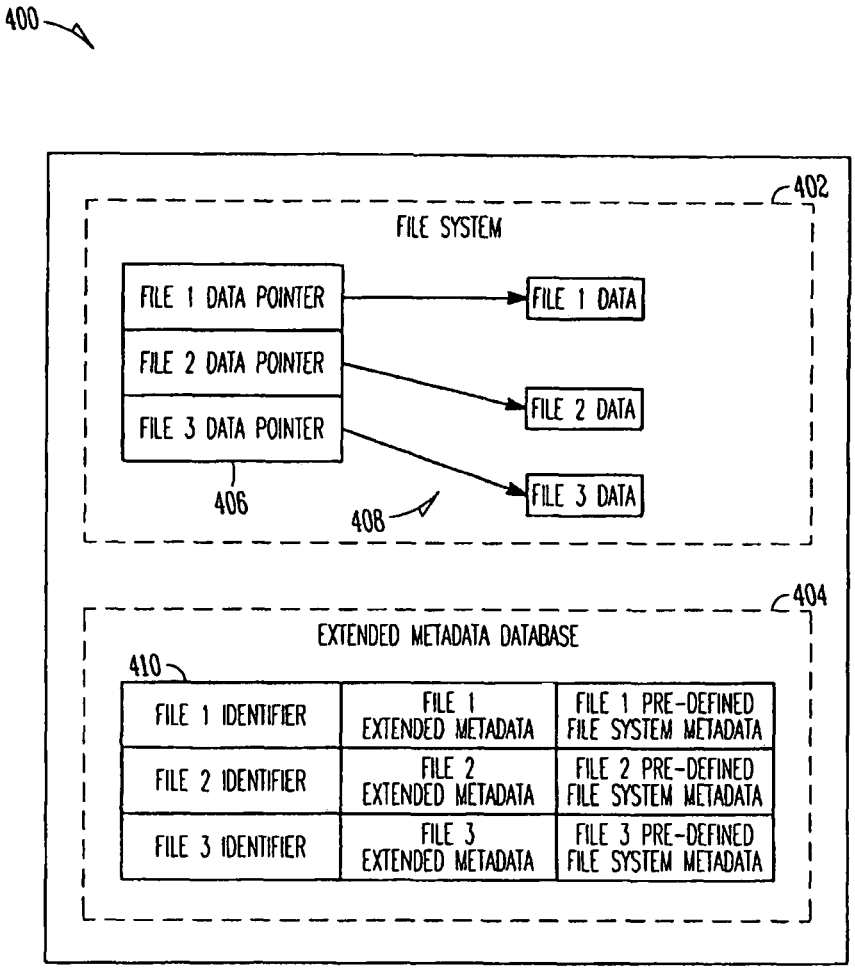
FIG. 4 is a block diagram illustrating a database for storing extended metadata separate from a file system, according to example embodiments of the invention.

While FIGS. 2-3C describe embodiments in which a extended metadata in a file system, FIG. 4 describes embodiments in which extended metadata is stored separately from a file system.

FIG. 4 is a block diagram illustrating a database for storing extended metadata separate from a file system, according to example embodiments of the invention. In FIG. 4, a wagering game machine 400 includes a file system 402 separate from an extended metadata database 404. The file system 402 can store files which include wager gaming content or other suitable data, whereas the extended metadata database 404 can store extended metadata associated with the files.

The file system 402 includes an index table 406 including references to file data 408. The extended metadata database 404 includes extended metadata and pre-defined file system metadata associated with each of the files stored in the file system 402. The file identifiers 410 of the extended metadata database 404 can be unique identifiers associated with the files stored in the file system 402. The unique identifiers can include file hashes, file names including a full directory path, Unix Inode numbers, etc.

Because the extended metadata database 404 is separate from the file system 402, components of the wager gaming machine 400 (e.g., value input devices, wagering game presentation unit, etc.) can create, process, and store varying types of extended metadata without modifying the file system 402. In one embodiment, typical operating-system-supported file operations can be augmented with operations that processes extended metadata in the extended metadata database 404. For example, high-level programming language "file open" operations can be augmented to fetch a file's extended metadata from the extended metadata database 404. In one embodiment, the operating system modules 136 can notify wagering game machine components when extended metadata associated with certain files has been updated.

In one embodiment, wagering game machine components can request a file's extended metadata independently of the file's wager gaming content. For example, the application module 134 can search and access (e.g., via the operating system modules 136) the extended metadata database 404 without searching and accessing wager gaming content stored in the file system 402. Thus, the application module 134 or other components can request extended metadata of a particular type identifier without identifying a file associated with the request. Components can then request wager gaming content based on the results of searches of the extended metadata. For example, an extended metadata type identifier may be "integrity validation requirement" with corresponding extended metadata values of "high" and "low." An integrity validation application (not shown) can query the extended metadata to identify files having these extended metadata type identifiers and values. The integrity validation application may then create a task list to process wagering game content of all files having "high" integrity validation requirements.

Embodiments in which the extended metadata is stored in the file system can also separately search the extended metadata without accessing wager gaming content.

Example Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic (e.g., firmware). In some embodiments the operations are performed in series, while in other embodiments, the operations can be performed in parallel.

The following discussion will describe embodiments in which some of the example operations are performed by operating system modules, while others of the example operations are performed by application modules. This section continues with a discussion of FIG. 5.

Creating and Storing Extended Metadata

Figure 5:
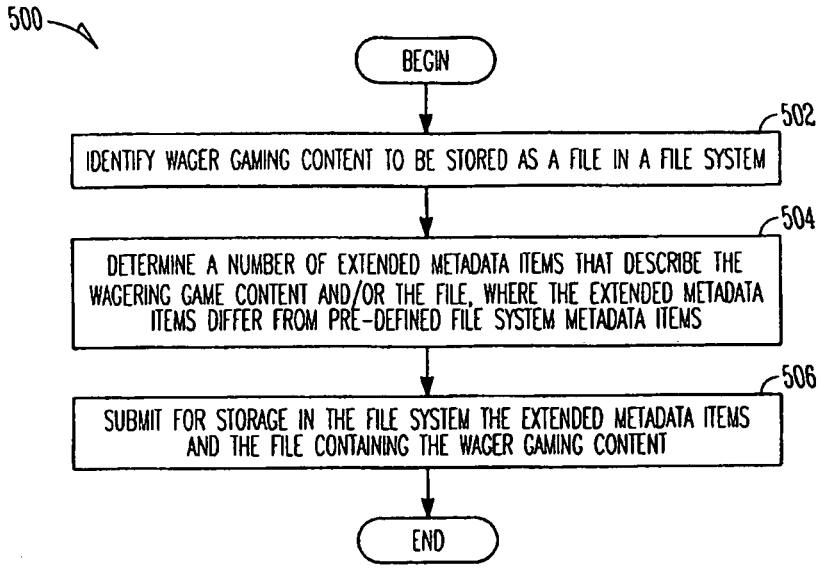
FIG. 5 is a flow diagram illustrating operations for creating and processing files and extended metadata, according to example embodiments of the invention.

FIG. 5 is a flow diagram illustrating operations for creating and processing files and extended metadata, according to example embodiments of the invention. The flow 500 begins at block 502.

At block 502, wager gaming content is identified for storage as a file in a file system. For example, the wager gaming presentation unit 132 identifies data that it wants to store in the file system 138. The flow continues at block 504.

At block 504, the wagering game presentation unit 132 determines a number of extended metadata items that describe the wagering game content, where the extended metadata items differ from pre-defined file system metadata items. In one embodiment, the extended metadata items can include information about wagering game machine components, conditions under which the file was created, statistics gathered about wagering game machine processes, or any other suitable information. In one embodiment, the extended metadata can include any number of dynamically-sized metadata items. The flow continues at block 506.

At block 506, the wager gaming presentation unit 132 submits the extended metadata items and the file containing the wager gaming content for storage in the file system. For example, the wager gaming presentation unit 132 performs an operating system call in which it submits the extended metadata and the file to the operating system modules 136 for storage in the file system 138. From block 506, the flow ends.

This description continues with a discussion of example operations that can be performed in response to an application module submitting a file and its associated extended metadata for storage. A discussion of FIG. 6 is next.

Figure 6:
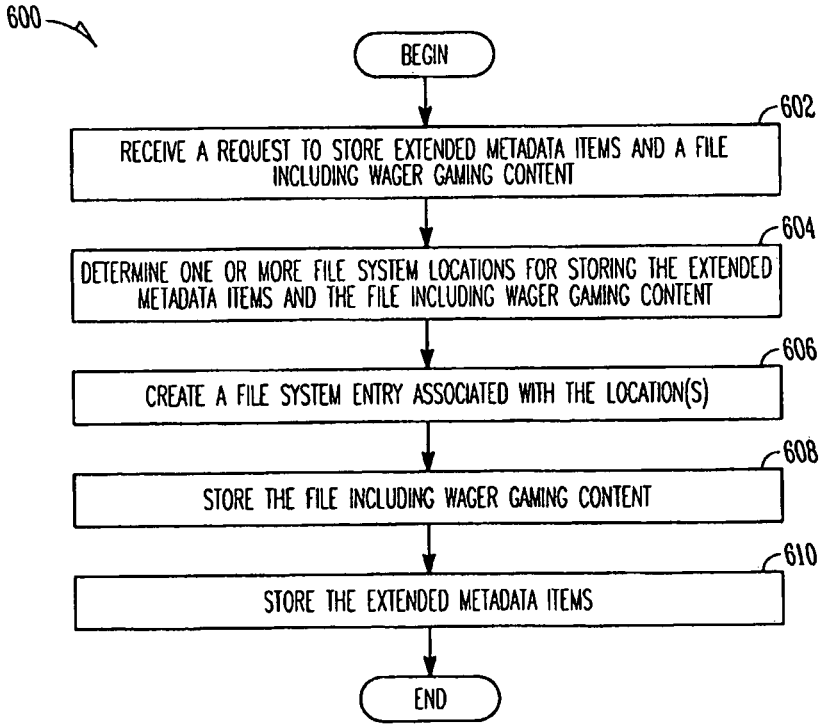
FIG. 6 is a flow diagram illustrating operations for storing a file and extended metadata associated with the file, according to example embodiments of the invention.

FIG. 6 is a flow diagram illustrating operations for storing a file and extended metadata associated with the file, according to example embodiments of the invention. The flow 600 begins at block 602.

At block 602, the operating system modules 136 receive a request (e.g., an operating system call) to store extended metadata items and a file including wager gaming content. In one embodiment, the operating system modules 136 receive the request from the application module 134. The flow continues at block 604.

At block 604, the operating system modules 136 determine one or more locations in the file system 138 for storing the extended metadata items and the file. In one embodiment, the extended metadata items can be of arbitrary number and arbitrary size. In one embodiment, the operating system modules 136 can store the extended metadata in a file's header (see FIGS. 3A & 3B). Alternatively, the operating system modules 136 can store the extended metadata in the file system 138 at storage locations separate from the file's wager gaming content (i.e., the file's data) (see FIGS. 2 and 3C). In yet another alternative, the operating system modules 136 can store the extended metadata and in storage locations outside from the file system 138 (see FIG. 4). The flow continues at block 606.

At block 606, the operating system modules 136 create a file system entry associated with the files system locations, which were chosen at block 604. The file system entry can be an entry in an i-node table, file allocation table, or other structure used for storing entries in a file system. Additionally, the file system entry can include a unique identifier associated with the file. The flow continues at block 608.

At block 608, the operating system modules 136 store the file's wager gaming content. At block 610, the operating system modules 136 store the extended metadata items associated with the file. The operating system 136 can store both the file data and the extended metadata in the file system, as shown in FIG. 2, 3A-3C. Alternatively, the operating system modules 136 can store the file data in the file system, while storing the extended metadata in a separate extended metadata database, as shown in FIG. 4. From block 610, the flow ends.

The discussion of FIGS. 5 and 6 described embodiments in which application programs create extended metadata while operating system programs store the extended metadata. This description continues with a discussion of FIG. 7, which describes embodiments in which operating system programs can create and store extended metadata.

Figure 7:
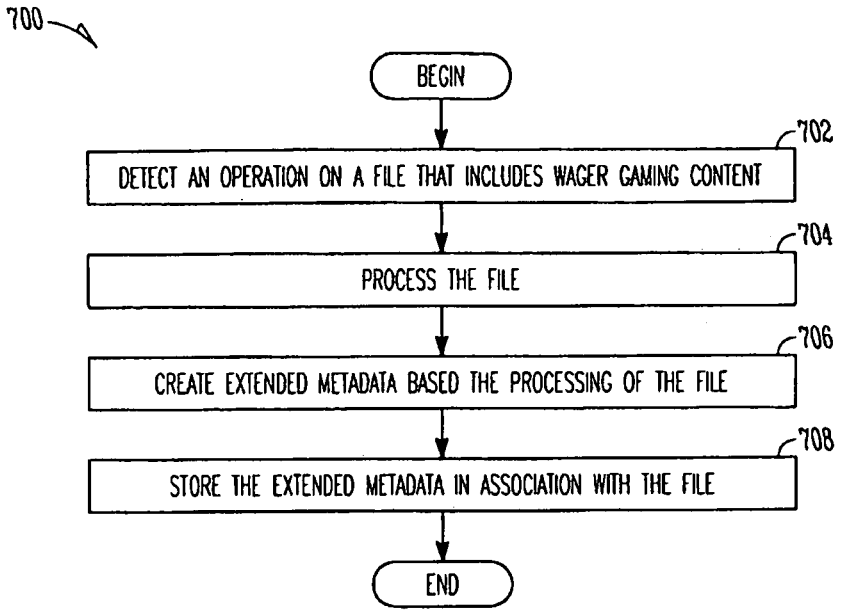
FIG. 7 is a flow diagram illustrating operations for creating and storing extended metadata in association with files containing wager gaming content, according to example embodiments of the invention.

FIG. 7 is a flow diagram illustrating operations for creating and storing extended metadata in association with files containing wager gaming content, according to example embodiments of the invention. The flow 700 begins at block 702.

At block 702, the operating system modules 136 detect a file operation performed in association with a file that includes wager gaming content. For example, the operating system modules 136 detects that the application module 134 has performed a file operation (e.g., file read, file write, file delete, etc.). The flow continues at block 704.

At block 704, the operating system modules 136 process the file. In one embodiment, the operating system modules 136 read the file's data (i.e., wager gaming content), the file's pre-defined file system metadata, and/or the file's extended metadata. The flow continues at block 706.

At block 706, the operating system modules 136 create extended metadata based on the processing of the file. For example, the operating system modules 136 create extended metadata based on the file's wager gaming content, the file's extended metadata, etc. The flow continues at block 708.

At block 708, the operating system modules 136 store the extended metadata in association with a file. For example, the operating system module 136 can store the extended metadata inside or outside the file system, as described vis-á-vis FIGS. 2-4. From block 708, the flow ends.

Retrieving and Processing Extended Metadata

This section continues with a discussion about operations for requesting a file and its extended metadata and operations for responding to such a request.

Figure 8:
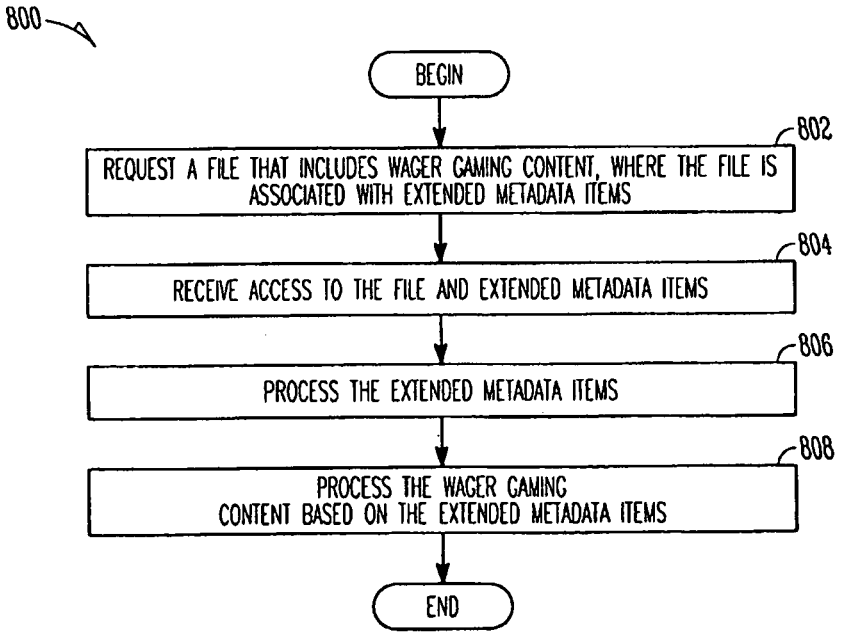
FIG. 8 is a flow diagram illustrating operations for requesting a file including wager gaming content, where the file is associated with extended metadata, according to example embodiments of the invention.

FIG. 8 is a flow diagram illustrating operations for requesting a file including wager gaming content, where the file is associated with extended metadata, according to example embodiments of the invention. The flow 800 begins at block 802.

At block 802, the application module 134 requests a file including wager gaming content, where the file is associated with extended metadata. In one embodiment, the application module 134 requests the file from the operating system modules 136. The flow continues at block 804.

At block 804, the application module 134 receives access to the file and the extended metadata. In one embodiment, the application module 134 receives from the operating system modules 136 one or more blocks of the file and the extended metadata associated with the file. The extended metadata can be included in the file (e.g., in the file header) or it can be separate from the file (e.g., in a table, record, or other data structure). The flow continues at block 806.

At block 806, the application module 134 processes the extended metadata. For example, the application module 134 reads the extended metadata. In one embodiment, the application module 134 can use the extended metadata items to determine how it will process the file's wager gaming content. For example, for a media file (e.g., an MPEG file), the application module 134 can process the extended metadata items to determine audio equalizer settings, volume settings, video contrast settings, resolution settings, etc. According to embodiments, the application module 134 can use the extended metadata for any suitable reason. The flow continues at block 808.

At block 808, the application module 134 processes the wager gaming content based on the extended metadata. For example, the application module 134 configures itself according to the media settings contained in the extended metadata and then presents the media file. Other embodiments perform other processes based on the extended metadata. From block 808, the flow ends.

This section continues with a discussion of operations performed in response to a request for a file and its associated extended metadata (e.g. see block 802 of FIG. 8).

Figure 9:
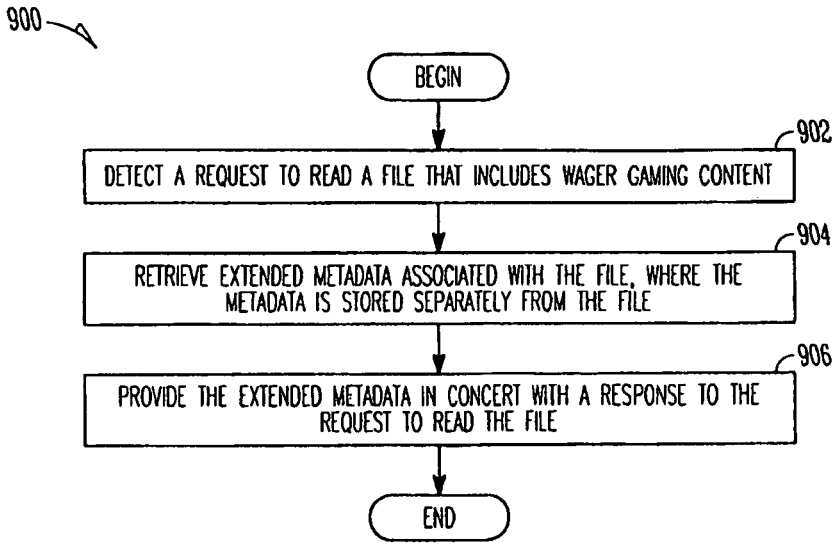
FIG. 9 is a flow diagram illustrating operations for retrieving extended metadata associated with a file that includes wager gaming content, according to example embodiments of the invention.

FIG. 9 is a flow diagram illustrating operations for retrieving extended metadata associated with a file that includes wager gaming content, according to 30. example embodiments of the invention. The flow 900 begins at block 902.

At block 902, the operating system modules 136 detect a request to access a file in a file system, where the file includes wager gaming content. For example, the operating system modules 136 receive an operating system call to read a file including wager gaming content. The flow continues at block 904.

At block 904, the operating system modules 136 retrieve extended metadata associated with the file. In one embodiment, the operating system modules 136 retrieve the extended metadata from a database or other storage locations outside the file system (e.g., see FIG. 4). Alternatively, the operating system modules 136 retrieve the extended metadata from storage locations inside the file system (e.g., see FIGS. 2-3C). The flow continues at block 906.

At block 906, the operating system modules 136 provide the extended metadata as part of responding to the file access request. In one embodiment, the operating system modules 136 return all or a portion of the file, where the file includes the extended metadata (e.g., the metadata can be included in the file header—see FIGS. 3A and 3B). In one embodiment, the operating system modules 136 deliver the file data (i.e., wager gaming data) and the extended metadata separately (e.g., in separate data structures). In one embodiment, the operating system modules 136 can translate between metadata formats, so the extended metadata can be used across different operating systems, such as Unix and MS-Windows®. From block 906, the flow ends.

Removing Extended Metadata from a File

Sometimes wagering game system providers want to send wager gaming content files without sending any metadata. As a result, they may want to remove associations between extended metadata and wager gaming files. This section continues with a discussion about operations for removing associations between wager gaming files and their associated extended metadata. The discussion continues with FIG. 10.

Figure 10:
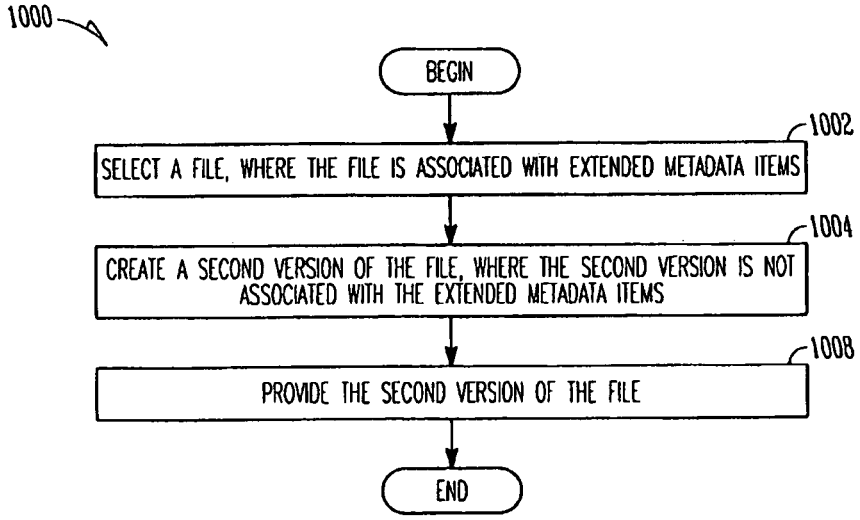
FIG. 10 is a flow diagram illustrating operations for removing in an association between a file and its extended metadata, according to example embodiments of the invention.

FIG. 10 is a flow diagram illustrating operations for removing an association between a file and its extended metadata, according to example embodiments of the invention. The flow 1000 and begins at block 1002.

At block 1002, the application module 134 selects a file that is associated with extended metadata. In one embodiment, the file includes wager gaming content. The flow continues at block 1004.

At block 1004, the application module 134 creates a second version of the file, where the second version is not associated with the extended metadata. For example, in an embodiment in which the extended metadata is stored in the file's header (see FIGS. 3A & 3B), the application module 134 creates a new file whose header does not include the extended metadata. In an embodiment in which the extended metadata is stored separately from the file, the application module 134 creates a file that has no reference to the extended metadata. The flow continues at block 1006.

At block 1006, the application program 134 provides the second version of the file. For example, the application program 134 provides the second version of the file to another component of the wagering game machine 106. Alternatively, the application program transmits the second version of the file to a network device. From block 1006, the flow ends.

Uses for Extended Metadata in Wagering Game Systems

This section continues with a discussion about how wagering game systems can use extended metadata, according to example embodiments of the invention. As discussed above, extended metadata can include information about wagering game machine components, wagering game players, wagering game data included within files, file systems, and entities that have processed files (e.g., a camera that created a file). Embodiments of the extended metadata are not limited to these examples, as the extended metadata can include information about any aspect of a wagering game machine or entities associated with it. Furthermore, any component of a wagering game machine (e.g., application module 134, operating system modules 136, information reader 118, etc.) can use the extended metadata. In one embodiment, the extended metadata can be encoded so that only "certified" machines can process the extended metadata. As a result, wagering game machine operators can limit access to extended metadata.

The following is a non-exhaustive list of example uses for extended metadata. The example uses can be used in concert with any of the operations discussed above.

Player Information—The extended metadata can include various player information, such as a player's persistent state information, player account file, and biometric information (e.g., digital fingerprint).

Meter Data—A Meter data file can include raw statistics about game play on a wagering game machine. For example, meter data can include total number of games played, total payout, total game play time, total bets, etc. A wagering game machine can include an accounting application module that processes the meter data to compile various statistics about the meter data (e.g., average payout per game, average game time, etc.). The application module can then store the various statistics as extended metadata associated with the meter data file.

File System Optimization—A wagering game machine can include an operating system module (e.g. see FIG. 1) that tracks information about files stored on a storage device, such as a hard disk drive. For example, the operating system module can compile statistics about when files are accessed, what components access the files, what order the files are accessed, what operations are performed on the files, etc. The operating system module can store these statistics as extended metadata associated with the files. The operating system module can also periodically process the metadata associated with each file and reorganize the storage device for efficiency. For example, the operating system module can physically rearrange the files on the hard disk to minimize mechanical latencies, such as read/write head movement and rotational movement. Alternatively, if numerous components often simultaneously access a file, the operating system module may create multiple copies of the file or subdivided the file. In one embodiment, some files stored on a hard disk drive may be associated with an extended metadata type identifier signifying when the file is read in relation to other files (i.e., "read sequence" extended metadata). An operating system module or application program can use information collected about the files to reorder files that include "read sequence" extended metadata. However, the operating system module or application program need not expend resources on files that do not include "read sequence" extended metadata.

File Integrity and Recoverability—An operating system module can store power tolerance flags in the extended metadata. For example, power tolerance flags can indicate transactional states of a file, such as: 1) uninitialized, 2) writing to medium, and 3) complete. The extended metadata can also include information about file parity and other system information. Storing system in a file's extended metadata can reduce overhead associated with debugging wager gaming machine code. For example, when power tolerance information is stored as part of a file's data (e.g., in a file's data section 304), the power tolerance flags are commingled with program code. However, when power tolerance information is stored as extended metadata, program code is not commingled with the power tolerance information. As a result, memory dump analysis is simplified because programmers do not have to distinguish between program code and power tolerance flags. Addionally, each file's extended metadata can include file hashes or signatures for verifying data integrity. In one embodiment, a file's integrity may be verified by running a hash or signature against the file and comparing the result to a hash value or signature stored in the file's extended metadata.

Virus Prevention—An operating system module can store virus information in a file's extended metadata. For example, the operating system module can store statistics about how many times a file has been infected, when the file was last checked for viruses, etc.

Compression—An operating system module or application program can store information about a compressed file in the file's extended metadata. Operating system components or application programs can use the information to uncompress parts of the file without uncompressing the entire file (e.g., with uncompressing all bytes preceding the desired part).

Example Wagering Game Machines and Networks

Example Wagering Game Machines

Figure 11:
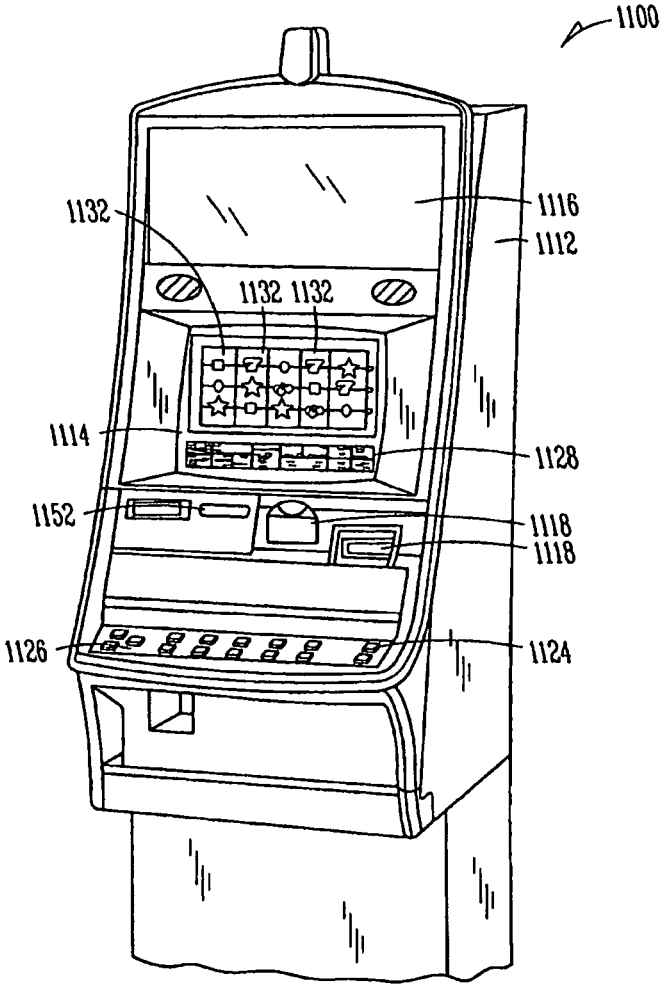
FIG. 11 is a perspective view of a wagering game machine, according to example embodiments of the invention.

FIG. 11 is a perspective view of a wagering game machine, according to example embodiments of the invention. Referring to FIG. 11, a wagering game machine 1100 is used in gaming establishments, such as casinos. According to embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bartop model, mobile handheld model, or workstation console model.

A player begins playing a basic wagering game by making a wager via the value input device 1118. The player can initiate play by using the player input device's buttons or touch screen 1128. The basic game can include arranging a plurality of symbols along a payline 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

Example Wagering Game Networks

Figure 12:
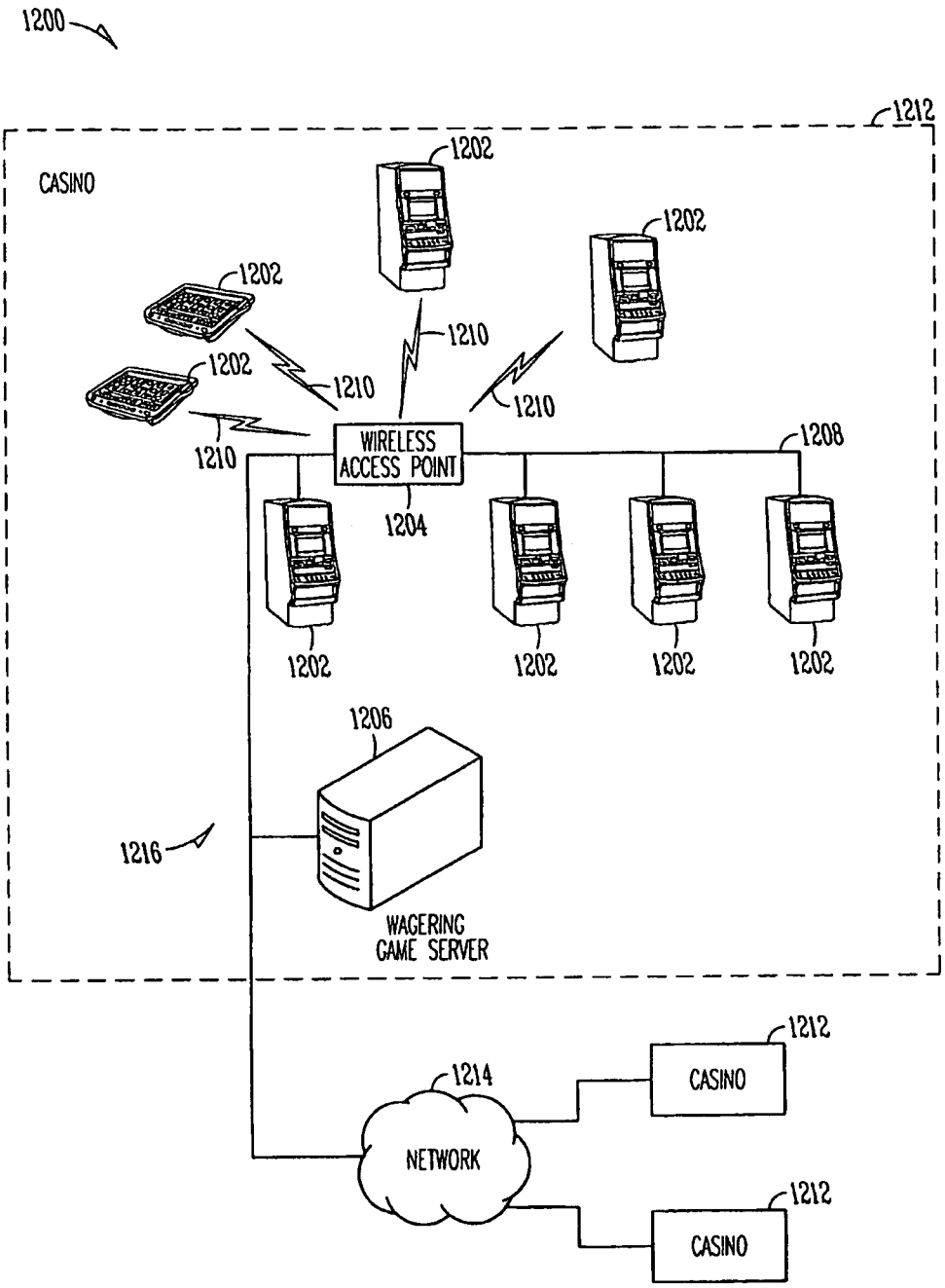
FIG. 12 is a block diagram illustrating a wagering game network, according to example embodiments of the invention.

FIG. 12 is a block diagram illustrating a wagering game network, according to example embodiments of the invention. As shown in FIG. 12, the wagering game network 1200 includes a plurality of casinos 1212 connected to a communications network 1214.

Each of the plurality of casinos 1212 includes a local area network 1216, which includes a wireless access point 1204, wagering game machines 1202, and a wagering game server 1206 that can serve wagering games over the local area network 1216. As such, the local area network 1216 includes wireless communication links 1210 and wired communication links 1208. The wired and wireless communication links can employ any suitable connection technology, such as Bluetooth, 802.11, Ethernet, public switched telephone networks, SONET, etc. In one embodiment, the wagering game server 1206 can serve wagering games and/or distribute content to devices located in other casinos 1212 or at other locations on the communications network 1214.

The wagering game machines 1202 and wagering game server 1206 can include hardware and machine-readable media including instructions for storing and processing extended metadata as described herein.

The wagering game machines 1202 described herein can take any suitable form, such as floor standing models, handheld mobile units, bartop models, workstation-type console models, etc. Further, the wagering game machines 1202 can be primarily dedicated for use in conducting wagering games, or can include non-dedicated devices, such as mobile phones, personal digital assistants, personal computers, etc. In one embodiment, the wagering game network 1200 can include other network devices, such as accounting servers, wide area progressive servers, player tracking servers, and/or other devices suitable for use in connection with embodiments of the invention.

General

In the following detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Each of the embodiments described herein are contemplated as falling within the inventive subject matter, which is set forth in the following claims.

The invention claimed is:

1. An apparatus comprising:

a processor;

a wagering game presentation unit configured for execution with the processor, the wagering game presentation unit configured to present wagering games based on wager gaming content and create extended metadata associated with the wager gaming content, the wager gaming content comprising data used to generate an electronic display of the wagering games with the wagering game presentation unit; and operating system modules configured for execution with the processor, the operating system modules configured to store the wager gaming content as a file in a file system, the operating system modules further configured to store the extended metadata at locations associated with the file;

wherein the extended metadata includes an identifier associated with the file and a hash value or signature for verifying the file's integrity, is stored in a database separate from the file system, and is different than predefined file system metadata.

2. The apparatus of claim 1 further comprising:

an application module configured for execution with the processor, the application module configured to request the file and the extended metadata from the operating system modules and to configure the wagering game presentation unit and the wagering games based on the extended metadata.

3. The apparatus of claim 1 further comprising:

an extended metadata database configured for execution with the processor, the extended metadata database configured to store the extended metadata, wherein the locations associated with the file are part of the extended metadata, and wherein the extended metadata database is separate from the file system.

4. The apparatus of claim 1, wherein the locations are inside the file system.

5. The apparatus of claim 1, wherein the extended metadata is different than predefined operating system metadata.

6. The apparatus of claim 1, wherein the extended metadata provides a plurality of metadata fields related to operations performed by the apparatus in connection with presentation of the wagering games, the operations including one or more of: file operations, display operations, or gaming operations.

7. A non-transitory machine-readable storage medium including instructions which when executed by a machine cause the machine to perform operations defined by the instructions, the instructions comprising:

instructions to receive a request to store extended metadata and wager gaming content in a file, wherein the wager gaming content comprises data used to generate an electronic display of one or more wagering games with a wagering game presentation unit, wherein the extended metadata is associated with the wager gaming content, wherein the extended metadata includes power tolerance information indicating at least one transactional state of the file, and wherein the extended metadata does not conform to a pre-defined file system metadata format;

instructions to store the file in a file system;

instructions to store the extended metadata at storage locations associated with and separate from the file.

8. The non-transitory machine-readable storage medium of claim 7, wherein the storage locations associated with the file are part of a header included in the file.

9. The non-transitory machine-readable storage medium of claim 7, wherein the header has a fixed size.

10. The non-transitory machine-readable storage medium of claim 7, wherein the header has a variable size.

11. The non-transitory machine-readable storage medium of claim 7, wherein the storage locations associated with the file are part of an extended metadata database that resides outside the file system.

12. The non-transitory machine-readable storage medium of claim 7, wherein the extended metadata includes information about components of a wagering game machine.

13. The non-transitory machine-readable storage medium of claim 7, wherein the extended metadata does not include information indicating the size of the file, when the file was created, and access rights to the file.

14. The non-transitory machine-readable storage medium of claim 7, wherein the transactional state of the file is selected from a group of transactional states including uninitialized, writing to medium, and complete.

15. A method comprising:

selecting a file that includes wager gaming content, wherein the file is associated with extended metadata, wherein the wager gaming content comprises data used to generate an electronic display of one or more wagering games with a wagering game presentation unit, wherein the extended metadata is associated with the wager gaming content and is different than predefined file system metadata, and wherein the extended metadata provides information to track presentation characteristics of the wager gaming content in the file and to track uses of the file by the wagering game presentation unit; and generating a second version of the file, where the second version of the file includes the wager gaming content but is not associated with the extended metadata and does not include any portion of the extended metadata.

16. The method of claim 15 further comprising:

transmitting the second version of the file over a communications network.

17. The method of claim 15, wherein the extended metadata does not include information indicating the size of the file, a time at which the file was created, or user access privileges of the file.

18. The method of claim 15, wherein the file is stored in a file system, and wherein the extended metadata does not conform to a predefined static metadata format of the file system.

19. The method of claim 15 wherein the second version of the file does not include pre-defined file system metadata.

* * * * *